US008052431B1

(12) United States Patent
He et al.

(10) Patent No.: US 8,052,431 B1
(45) Date of Patent: Nov. 8, 2011

(54) ELECTRICAL CONNECTOR HAVING IMPROVED INSULATIVE HOUSING

(75) Inventors: Jia-Yong He, Kunshan (CN); Qi-Sheng Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/097,080

(22) Filed: Apr. 29, 2011

(30) Foreign Application Priority Data

Apr. 30, 2010 (CN) ..... 2010 2 0176575.6

(51) Int. Cl.
*H01R 12/00* (2006.01)

(52) U.S. Cl. ..... 439/78

(58) Field of Classification Search ..... 439/78–80, 439/83–85, 733.1
See application file for complete search history.

(56) References Cited

U.S. PATENT DOCUMENTS 7,534,141 B1 * 5/2009 Wu ..... 439/607.01
7,618,293 B2 * 11/2009 Wu ..... 439/660
2003/0139095 A1 * 7/2003 Yang Lee ..... 439/607
2005/0227537 A1 * 10/2005 Peng ..... 439/607
2005/0245132 A1 * 11/2005 Huang et al. ..... 439/607
2009/0117785 A1 * 5/2009 Wu ..... 439/668
2009/0258514 A1 10/2009 He et al.

FOREIGN PATENT DOCUMENTS

CN 2704131 6/2005
TW M359828 6/2009

* cited by examiner

*Primary Examiner* — Tulsidas C Patel
*Assistant Examiner* — Phuong Nguyen
(74) *Attorney, Agent, or Firm* — Wei Te Chung; Andrew C. Cheng; Ming Chieh Chang

(57) ABSTRACT

An electrical connector includes an insulative housing having a base portion and a tongue potion extending forwardly from the base portion. The base portion has a mounting surface for being mounted to a printed circuit board upwardly, and a lower surface opposite to the mounting surface. The tongue portion has an upper side face, and a lower side face opposite to the upper side face. The mounting surface and the upper side face essentially are lied in a planar surface. A plurality of contacts are received the insulative housing and have contact portions exposed upon the upper side face of the tongue portion.

19 Claims, 5 Drawing Sheets

ELECTRICAL CONNECTOR HAVING IMPROVED INSULATIVE HOUSING

BACKGROUND OF THE INVENTION

1. Field of the Invention

The present invention relates to an USB connector or the like, and more particularly to an electrical connector having an improved insulative housing with lower deformation through molding process.

2. Description of Related Art

At present, Universal Serial BUS (USB) is a widely used as an input/output interface adapted for many electronic devices, such as personal computer and related peripherals. Chinese Patent issue No. 2704131Y discloses an universal serial bus (USB) connector which includes an insulative housing defining a base portion and a tongue portion extending forwardly from the base portion, a plurality of contacts retained in the base portion and extending on the tongue portion for mating with a receptacle connector, and a metal shell shielding the insulative housing and defining an interface with the tongue portion extending therein.

Usually, the contacts of a typical USB connector have contacting portions coupled to the tongue portion, and tail portions retained in a rear portion of the base portion and extending out of the rear portion. The base portion has a step portion extending from an upper portion thereof and being higher than the tongue portion, and a mounting space recessed below the step portion for receiving a front edge of a printed circuit board therein. While the electrical connector is mounted on the printed circuit board, the step portion presses onto an upper surface of the printed circuit board, and the tail portions are soldered onto the upper surface of the printed circuit board. However, when the insulative housing is formed through the molding process, the step portion of the insulative housing is easy deformed during molding.

Hence, an improved connector with an improved housing is desired to overcome the above problems.

BRIEF SUMMARY OF THE INVENTION

According to one aspect of the present invention, an electrical connector is for being mounted on a printed circuit board, comprises: an insulative housing having a base portion and a tongue potion extending forwardly from the base portion, the base portion having a mounting surface for being mounted to the printed circuit board upwardly, and a lower surface opposite to the mounting surface, the tongue portion having an upper side face, and a lower side face opposite to the upper side face, the mounting surface and the upper side face essentially lied in a first planar surface; and a plurality of contacts attached to the insulative housing and having contact portions exposed upon the upper side face of the tongue portion, and tail portions extending backwardly and beyond the insulative housing and adapted for being soldered onto the printed circuit board.

According to another aspect of the present invention, an electrical connector comprises: an insulative housing forming an U-shaped viewed from a front side and a reversed T-shaped viewed from a lateral side, the insulative housing including a base portion and a tongue portion extending forwardly from the base portion, the base portion having a front part adjacent to the tongue portion, two spaced apart side walls protruding upwardly from two lateral sides of the front part, and a rear part extending backwardly from the front part and opposited to the tongue portion in a front-to-back direction; a metal shell mounted on the insulative housing and enclosing the tongue portion to define a mating port therebetween; a plurality of first contacts having elastic contact portions protruding into the mating port; and a plurality of second contacts having nonelastic contact portions located forward the elastic contact portions along the front-to-back direction, the elastic and the nonelastic contact portions being located on a same side of the tongue portion.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details.

Figure 1:
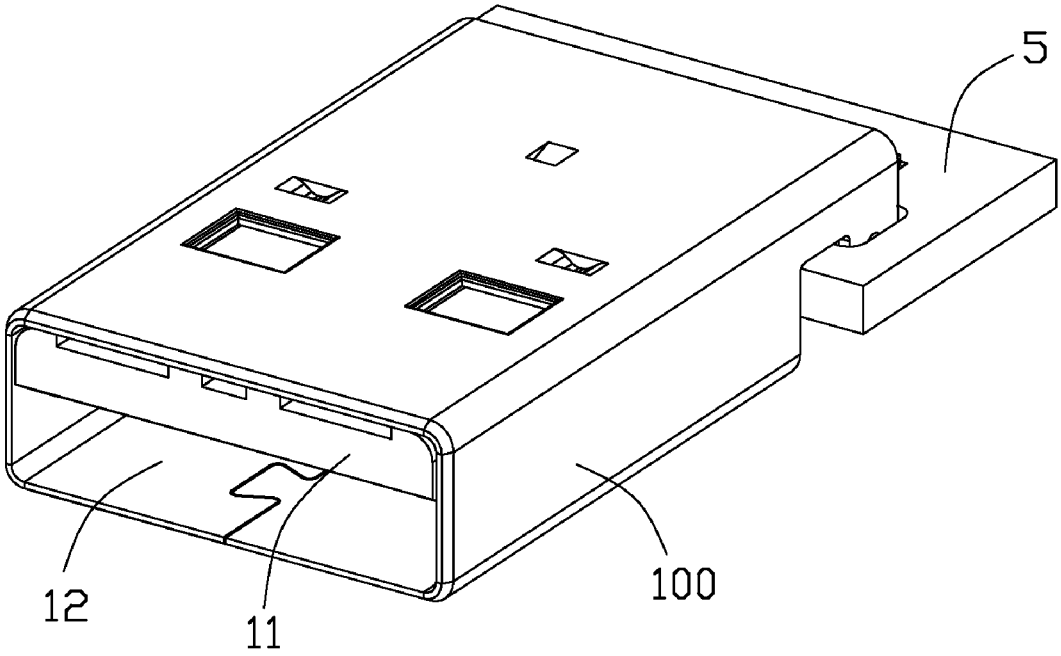
FIG. 1 is an assembled, perspective view of an electrical connector which is mounted on a printed circuit board according to an embodiment of the present invention.
Figure 2:
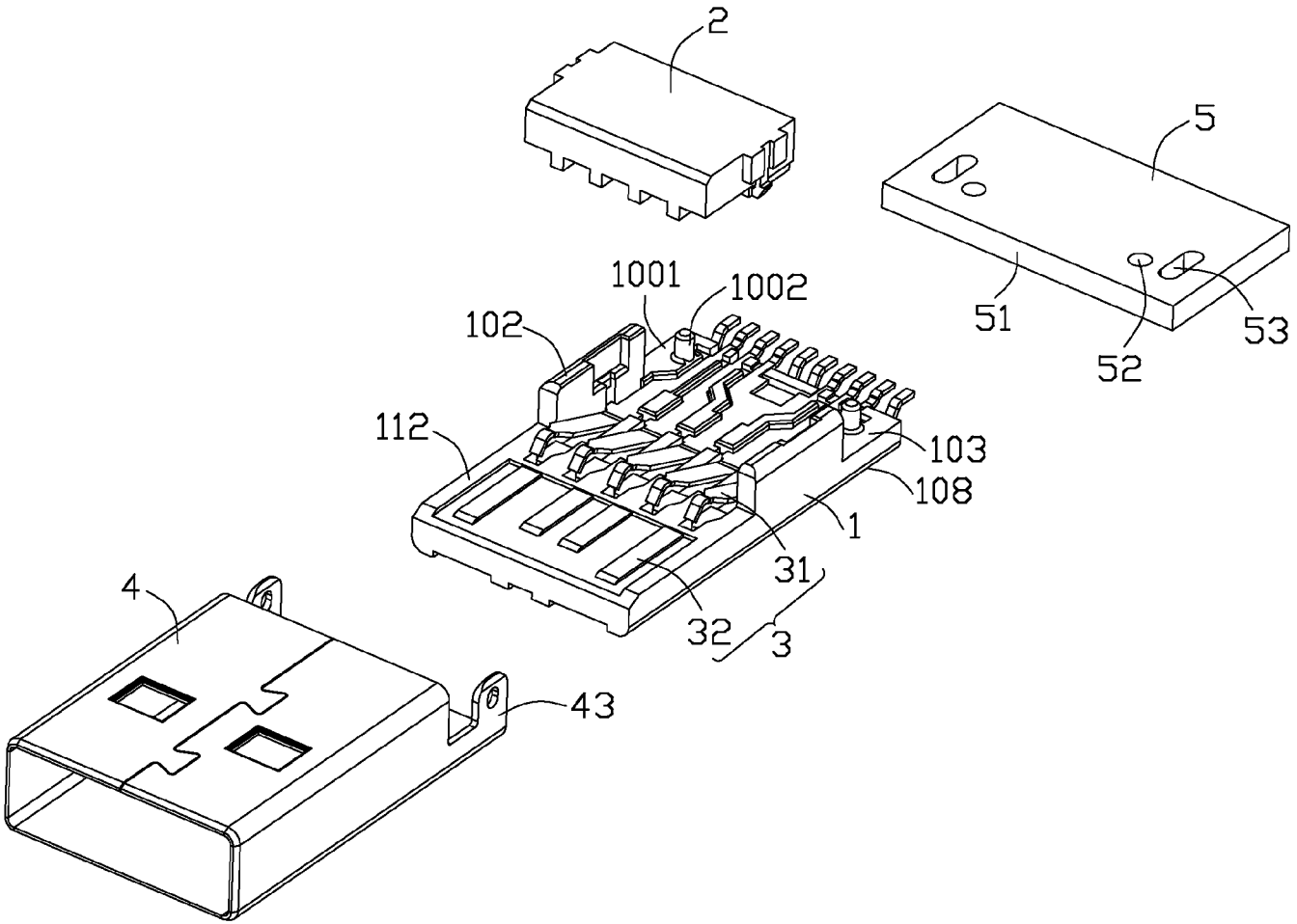
FIG. 2 is a partially exploded view of the electrical connector with the printed circuit board shown in FIG. 1.

Referring to FIGS. 1-2, an electrical connector 100 according to an embodiment of the present invention is an A type USB 3.0 plug electrical connector. The electrical connector 100 is adapted for being mounted onto a printed circuit board 5 and comprises an insulative housing 1, an insulator 2 retained in the insulative housing 1, a plurality of contacts 3 received in the insulative housing 1, and a metal shell 4 shielding the insulative housing 1 and the insulator 2.

Figure 3:
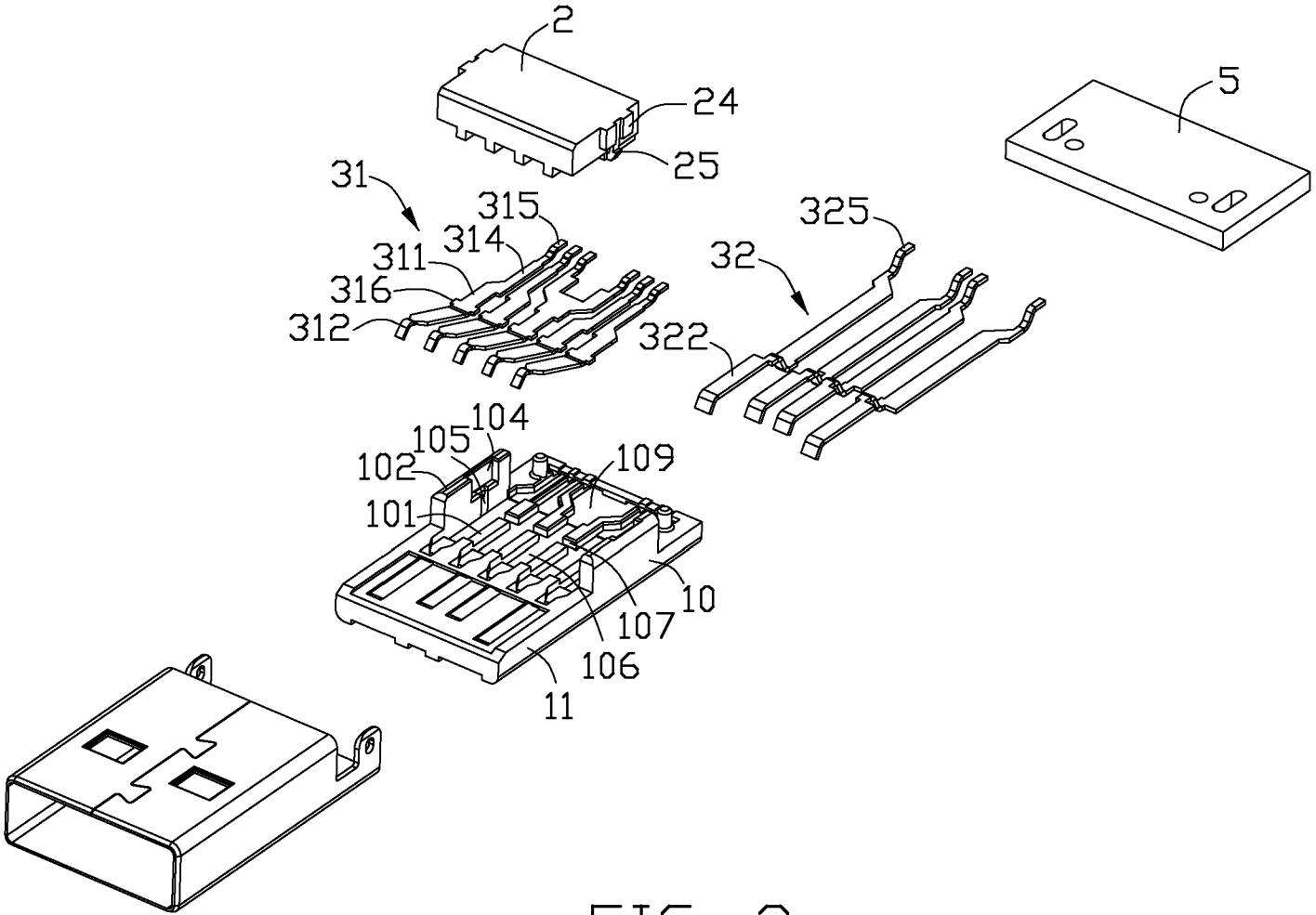
FIG. 3 is an exploded view of the electrical connector with the printed circuit board shown in FIG. 1.
Figure 4:
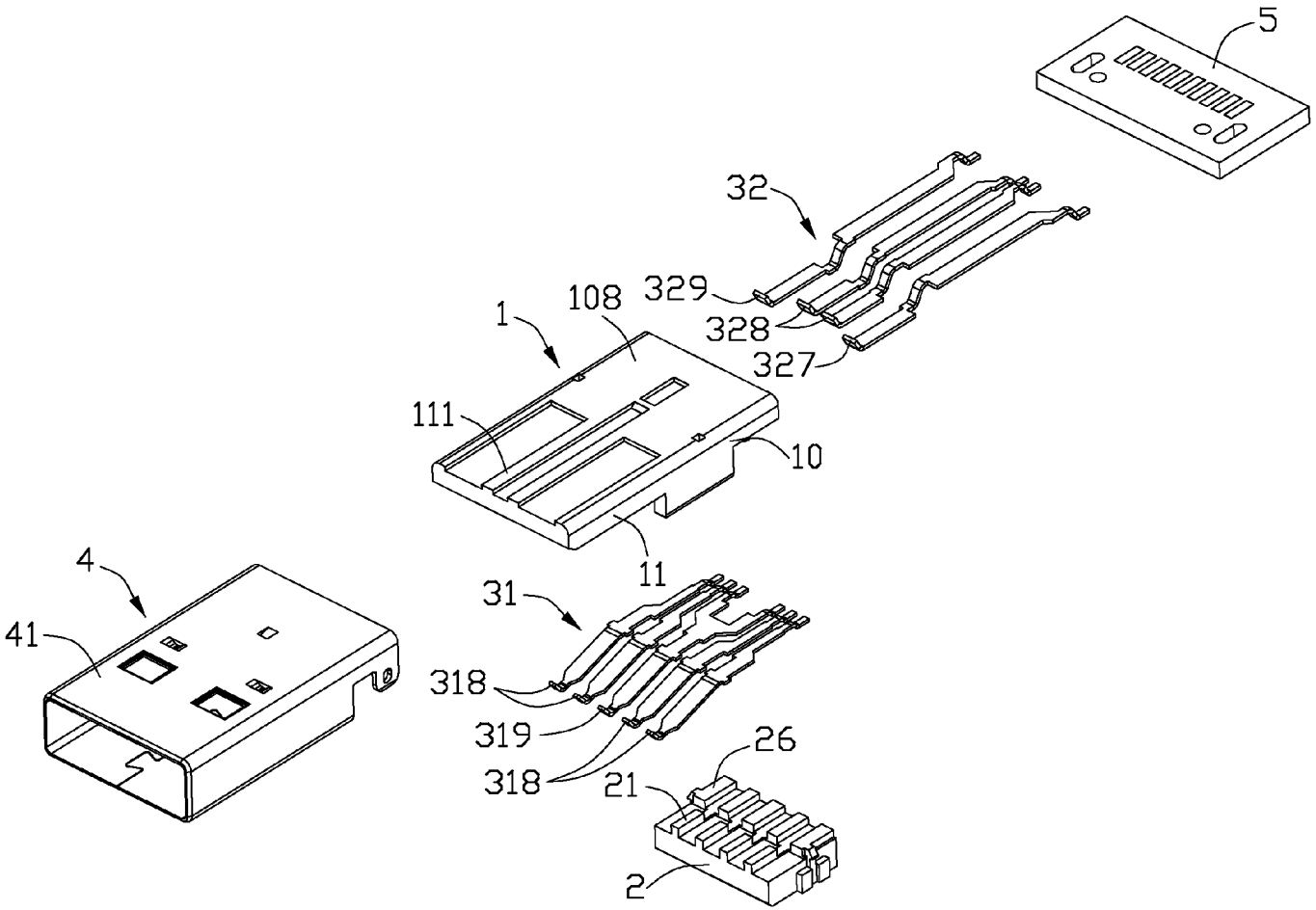
FIG. 4 is similar to FIG. 3, but viewed from another aspect.

Referring to FIGS. 2-4, the insulative housing 1 extends along a front-to-back direction, and forms an U-shaped viewed from a front side and a reversed T-shaped viewed from a lateral side. The insulative housing 1 includes a base portion 10 and a tongue portion 11 extending forwardly from the base portion 10. The metal shell 4 surrounds around the tongue portion 11 to form a mating port 12 therebetween for receiving a complementary connector (not shown) therein. The tongue portion 11 has an upper side face 112 and a lower side face 111 opposite to the upper side face 112. The base portion 10 is adapted for being mounted onto the printed circuit board 5 upwardly and has a mounting surface 103 adapted for being mounted to the printed circuit board 5, and a lower surface 108 opposite to the mounting surface 103. The upper side face 112 and the mounting surface 103 are essentially lied in a first planar surface. The lower side surface 111 and the lower surface 108 are lied in a second planar surface opposite to the first planar surface in a vertical direction perpendicular to the front-to-back direction.

The base portion 10 defines a pair of side walls 102 protruding upwardly from the mounting surface 103 of a front side thereof, and a cavity 101 formed therebetween to retain the insulator 2 therein. The pair of side walls 102 are located at two lateral sides of the base portion 10 respectively. The cavity 101 and the side walls 102 are adjacent to the mating port 12 respectively. The base portion 10 further has a mounting space 1001 located above the mounting surface 103 and behind the cavity 101 for receiving a front edge 51 of the printed circuit board 5, and a pair of positioning posts 1002 disposed in the mounting space 1001 for being mounted into two through holes 52 of the printed circuit board 5.

The side walls 102 each defines a recess 104 depressed outwardly from a top part of an inner surface thereof and communicating with the cavity 101, and a latching slot 105 recessed from a bottom part of the inner surface thereof with a deeper depth communicating with the recess 104. The recess 104 is longer than the latching slot 105 along the front-to-back direction. The base portion 10 defines a plurality of retaining slots 106 recessed from the mounting surface 103 and disposed below the cavity 101, a plurality of locating slots 107 which each is communicated with each two adjacent retaining slots 106, and a plurality of holding grooves 109 extending from the retaining slots 106 and passing therethrough backwardly, respectively. The holding grooves 109 also are recessed from the mounting surface 103 downwardly.

The insulator 2 and the side walls 102 of the insulative housing 1 have a same length along the front-to-back direction. The insulator 2 has a pair of flanges 24 protruding outwardly from two lateral side surfaces thereof, a pair of latch blocks 25 protruding outwardly from lower ends of the corresponding flanges 24, a plurality of ribs 21 formed on a lower surface thereof, and a plurality of resisting portions 26 formed on the lower surface thereof and located behind the ribs 21 respectively. The ribs 21 and the resisting portions 26 are staggered with each other in the front-to-back direction, respectively.

The contacts 3 are adapted for USB 3.0 protocol, and include a plurality of first contacts 31 and a plurality of second contacts 32 being insert molded in the insulative housing 1. The first contacts 31 consist of two pairs of differential contacts 318 and a grounding contact 319 disposed between each pair of the differential contacts 318. The first contacts 31 each includes a retaining portion 311, a elastic first contact portion 312 extending forwardly from the retaining portion 311, a holding portion 314 extending backwardly from the retaining portion 311, and at least one tail portion 315 extending beyond the insulative housing 1 from the holding portion 314. The retaining portion 311 each is presented as cross-shaped viewed from a top side and has a pair of projections 316 protruding outwardly from two lateral sides thereof. The grounding contact 319 defines a split to form two tail portions 315 spaced from each other in a transverse direction perpendicular to both the front-to-back direction and the vertical direction.

The first contacts 31 are retained in the insulative housing 1 downwardly. The retaining portions 311 are received in the corresponding retaining slots 106 respectively for being prevented from moving in the transverse direction. The projections 316 are received in the corresponding locating slots 107 for being prevented from moving along the front-to-back direction. The holding portions 314 are received in the corresponding holding grooves 109 for being prevented from moving along the transverse direction.

The insulator 2 is received in the cavity 101 of the insulative housing 1 downwardly and cooperates with the insulative housing 1 to commonly define a whole housing contour. The flanges 24 are retained in the recess 104 of the side walls 102 of the cavity 101 to prevent the insulator 2 from moving in the front-to-back direction. The latching blocks 25 lock into the latching slots 105 respectively to being prevented from moving upwardly respect to the insulative housing 1. The ribs 21 abut downwardly against a bottom wall of the cavity 101. The first contact portions 312 of the first contacts 31 can receivable vertically project within corresponding spaces between each two adjacent ribs 21 and project aslant. The resisting portions 26 abut downwardly against the corresponding retaining portions 311 and the projections 316 after projecting into the corresponding retaining slots 106 and locating slots 107 respectively. Therefore, the retaining portions 311 and the projections 316 are sandwiched between the insulative housing 1 and the insulator 2 in the vertical direction.

The second contacts 32 are adapted for USB 2.0 protocol and consist of a grounding contact 329, a power contact 327 and a pair of differential contacts 328 disposed between the grounding contact 329 and the power contact 327. The second contacts 32 are insert molded into the insulative housing 1, and each includes a stiff second contact portion 322 retained in the tongue portion 11 and exposed into the mating port 11, and a tail portion 325 extending rearwardly beyond the insulative housing 1. The second contacts portions 322 are non-elastic respectively.

Figure 5:
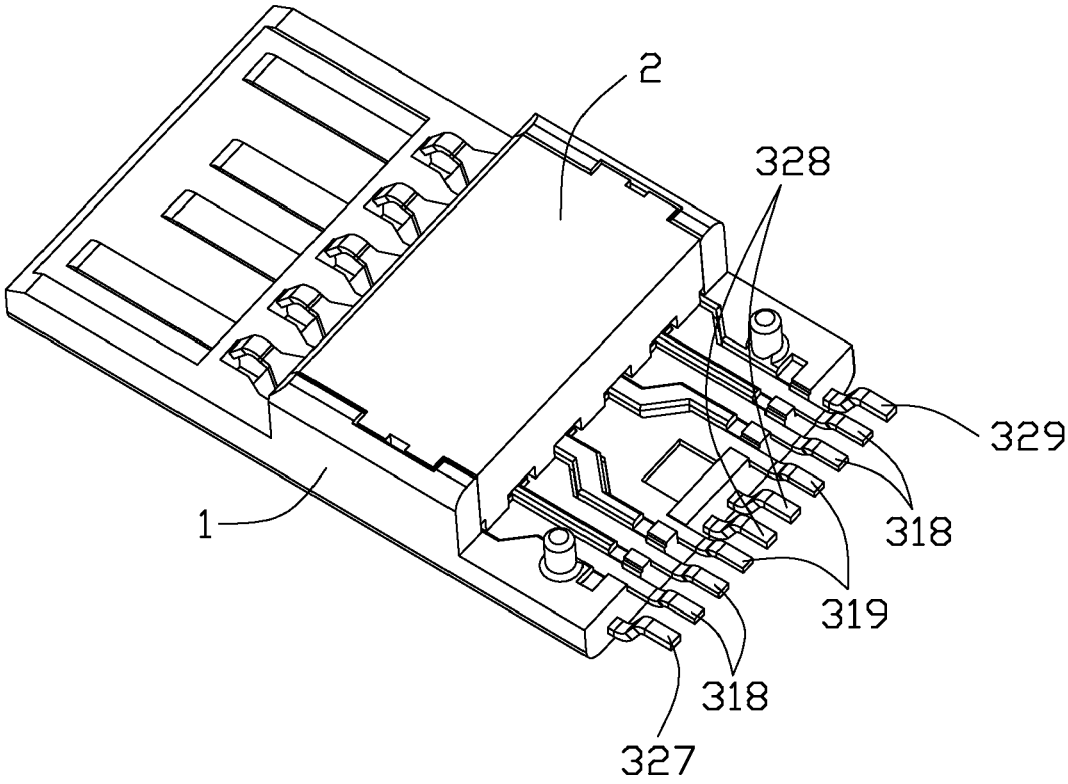
FIG. 5 is a perspective view of the electrical connector with a metal shell removed therefrom.

Referring to FIGS. 2 and 5, the first contact portions 312 and the second contact portions 322 are exposed upon the upper side face 112 of the tongue portion 11. The first contact portions 312 of the first contacts 31 and the contact portions 322 of the second contacts 32 are essentially alternately arranged with each other in the transverse direction, and the first contact portion 312 of the first contacts 31 are located behind the contact portion 322 of the second contacts 32 in the front-to-back direction. The tail portions 315, 325 are arranged in one row in the transverse direction and a planar surface that is substantially coplanar with the mounting surface 103. All of the tail portions 315 of the first contacts 31 are arranged between the tail portions 325 of power contact 327 and the grounding contact 329 of the second contacts 32. In another word, relative to the tail portions 315, 325, two tail portions 325 of the power contact 327 and the grounding contact 329 are arranged at two outermost sides. The tail portions 325 of the pair of differential contacts 328 of the second contacts 32 are arranged between the two tail portions 315 of the grounding contact 319 of the first contacts 31.

Referring to FIGS. 2 and 4, the metal shell 4 surrounds the tongue portion 11 to form the mating port 11 therebetween and includes a bottom plate 41, a pair of mounting plates 43 extending from two lateral sides one a rear end of the bottom plates 41 upwardly and adapted for inserting into a mounting holes 52 of the printed circuit board 5.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for being mounted on a printed circuit board, comprising:

an insulative housing having a base portion and a tongue potion extending forwardly from the base portion, the base portion having a mounting surface for being mounted to the printed circuit board upwardly, and a lower surface opposite to the mounting surface, the tongue portion having an upper side face, and a lower side face opposite to the upper side face, the mounting surface and the upper side face essentially lied in a first planar surface; and a plurality of contacts attached to the insulative housing and having contact portions exposed upon the upper side face of the tongue portion, and tail portions extending backwardly and beyond the insulative housing and adapted for being soldered onto the printed circuit board;

wherein the electrical connector is a type USB 3.0 plug electrical connector, the contacts include a set of first contacts with elastic contact portions, and a set of second contacts with nonelastic contact portions, the first contacts include two pairs of differential contacts, and a grounding contact disposed between each pair of the differential contacts and having two spaced apart tail portions, the second contacts include a grounding contact, a power contact and a pair of differential contacts disposed between the grounding contact and the power contact, the tail portions of the first and the second contacts are arranged in one row in the transverse direction, a tail portion of the grounding contact of the second contacts and another tail portion of the power contact are arranged at two outermost sides of the row, two tail portions of the pair of differential contacts of the second contacts are arranged between two tail portions of the grounding contacts of the first contacts, the tail portions of the first contacts and the second contacts are arranged in a planar surface that is substantially coplanar with the mounting surface.

2. The electrical connector according to claim 1, wherein the lower surface of the base portion and the lower side face are essentially lied in a second planar surface opposite to the first planar surface in a vertical direction.

3. The electrical connector according to claim 1, further comprising a metal shell shielding the insulative housing, the shell surrounds around the tongue portion to form a mating port therebetween, the base portion defines a mounting space located above the mounting surface and adapted for receiving a front edge of the printed circuit board, the mounting space is opposited to the mating port in a front-to-back direction perpendicular to the vertical direction.

4. The electrical connector according to claim 3, further comprising an insulator grasping the insulative housing to secure the contacts therebetween in the vertical direction, the insulator is located between the mating port and the mounting space along the front-to-back direction.

5. The electrical connector according to claim 1, wherein the base portion has a pair of side walls protruding upwardly from the mounting surface of a front side thereof, and a cavity formed therebetween to retain the insulator therein, the cavity communicates with both the mating port and the mounting space.

6. The electrical connector according to claim 5, wherein insulative housing forms an U-shaped viewed from a front side, the side wall each defines a recess depressed outwardly from a top part of an inner surface thereof and communicating with the cavity, and a latching slot recessed from a bottom part of the inner surface thereof with a deeper depth communicating with the recess, the insulator has a pair of flanges protruding outwardly from two lateral side surfaces thereof, a pair of latching blocks protruding outwardly from lower ends of the corresponding flanges, the recess is longer than the latching slot along the front-to-back direction, the flanges are retained in the recesses downwardly, the latching blocks are locked into the latching slots respectively to prevent the insulator from moving upwardly respect to the insulative housing.

7. The electrical connector according to claim 5, wherein the base portion defines a plurality of retaining slots recessed from the mounting surface and disposed below the cavity, and a plurality of locating slots which each is communicated with each two adjacent retaining slots, the contacts extend along the front-to-back direction and include retaining portions extending backwardly from the contact portions, the retaining portions each is presented as cross-shaped viewed from a top side and has a pair of projections protruding outwardly from two lateral sides thereof, the retaining portions are retained in the corresponding retaining slots respectively for being prevented from moving in a transverse direction perpendicular to both the front-to-back direction and the vertical direction, the projections are retained in the corresponding retaining slots for being prevented from moving along the front-to-back direction.

8. The electrical connector according to claim 7, wherein the insulator has a plurality of ribs formed on a lower surface thereof, and a plurality of the resisting portions formed on the lower surface thereof and located behind the ribs respectively, the ribs and the resisting portions are staggered with each other in the front-to-back direction, respectively, the contact portions are located within corresponding spaces between each two adjacent ribs and project aslant, the resisting portions abut against the corresponding retaining portions after projecting into the retaining slots respectively.

9. An electrical connector comprising:

an insulative housing forming an U-shaped viewed from a front side and a reversed T-shaped viewed from a lateral side, the insulative housing including a base portion and a tongue portion extending forwardly from the base portion, the base portion having a front part adjacent to the tongue portion, two spaced apart side walls protruding upwardly from two lateral sides of the front part, and a rear part extending backwardly from the front part and opposited to the tongue portion in a front-to-back direction;

a metal shell mounted on the insulative housing and enclosing the tongue portion to define a mating port therebetween;

a plurality of first contacts having elastic contact portions protruding into the mating port; and a plurality of second contacts having nonelastic contact portions located forward the elastic contact portions along the front-to-back direction, the elastic and the nonelastic contact portions being located on a same side of the tongue portion;

wherein the electrical connector is an A type USB 3.0 plug electrical connector, the first contacts include two pairs of differential contacts, and a grounding contact disposed between each pair of the differential contacts and having two spaced apart tail portions, the second contacts include a grounding contact, a power contact and a pair of differential contacts disposed between the grounding contact and the power contact, the tail portions of the first and the second contacts are arranged in one row in the transverse direction, a tail portion of the grounding contact of the second contacts and another tail portion of the power contact are arranged at two outermost sides of the row, two tail portions of the pair of differential contacts of the second contacts are arranged between two tail portions of the grounding contacts of the first contacts, the tail portions of the first contacts and the second contacts are arranged in a planar surface that is substantially coplanar with the mounting surface.

10. The electrical connector according to claim 9, wherein the tongue portion, the front part and the rear part have an essential same thickness in a vertical direction perpendicular to the front-to-back direction, and an essential same width in a transverse direction perpendicular to both the front-to-back direction and the vertical direction.

11. The electrical connector according to claim 9, wherein the base portion has a mounting surface for being mounted onto the printed circuit board, and a lower surface opposite to the mounting surface, the tongue portion has an upper side face upon which the contact portions exposed, and a lower side face opposite to the upper side face, the mounting surface and the upper side face are essentially lied in a first planar surface, the lower surface of the base portion and the lower side face are essentially lied in a second planar surface opposite to the first planar surface in the vertical direction, the contacts further have tail portions arranged in the first planar surface and adapted for being mounted onto the printed circuit board.

12. The electrical connector according to claim 9, further comprising an insulator retained in a cavity formed among the front part and the side walls, the contacts are sandwiched between the insulative hosing and the insulator either in the front-to-back direction or in the vertical direction.

13. The electrical connector according to claim 12, wherein the base portion has a mounting space for receiving a front edge of a printed circuit board therein, the mounting space communicates with the cavity and is opposited to the mating port in the front-to-back direction.

14. An electrical connector comprising:

an insulative housing essentially extending in a front-to-back direction in a straight manner;

a mating plate located on a front portion of the housing and defining a mating fact exposed to an exterior in a first vertical direction perpendicular to said front-to-back direction;

a plurality of first contacts disposed in the housing and arranged with one another in a transverse direction perpendicular to both said front-to-back direction and said first vertical direction, each of said first contacts defining a front first contacting section exposed upon the mating face, and a rear first tail section;

a plurality of second contacts disposed in the housing and arranged with one another in said transverse direction, each of said second contacts defining a front second contacting section exposed upon the mating face, and a rear second tail section under condition that the front first contacting sections and the front second contacting sections are essentially offset from each other in both front-to-back direction and said first vertical direction;

a printed circuit board located behind a rear side of the housing and defining thereon a mounting surface facing toward the exterior in a second vertical direction opposite to said first vertical direction so as to confront the corresponding rear first tail sections and second tail sections which approach the printed circuit board in said first vertical direction;

wherein the electrical connector is an A type USB 3.0 plug electrical connector, the first contacts defining elastic first contacting sections, and the second contacts defining nonelastic contact sections, the first contacts include two pairs of differential contacts, and a grounding contact disposed between each pair of the differential contacts and having two spaced apart tail sections.

15. The electrical connector as claimed in claim 14, wherein the housing is enclosed in the metallic shell, and both said housing and said shell include mounting devices fastened to the printed circuit board.

16. The electrical connector as claimed in claim 14, wherein during mating, the front first contacting sections are still while the front second contacting sections are deflectable, and wherein the second contacts are assemble to the housing in the second vertical direction.

17. The electrical connector as claimed in claim 14, wherein the mating face of the housing and the mounting face of printed circuit board are essentially located at a similar level.

18. The electrical connector as claimed in claim 17, wherein said housing defines a stepped structure on the rear side to receive a front edge portion of the printed circuit board.

19. The electrical connector as claimed in claim 17, wherein said front first tail sections and said front second tail sections are of a surface mounting type and located at the similar level with the mating face.

* * * * *